United States Patent [19]

Dishman

[11] Patent Number: 4,964,601

[45] Date of Patent: Oct. 23, 1990

[54] CONTAINER FOR ATTACHMENT TO A LADDER

[76] Inventor: Paul L. Dishman, 116 Brainerd Blvd., Sharon Hill, Pa. 19079

[21] Appl. No.: 326,310

[22] Filed: Mar. 21, 1989

Related U.S. Application Data

[63] Continuation-in-part of Ser. No. 209,545, Jun. 21, 1988, abandoned.

[51] Int. Cl.[5] ..... E06C 7/14

[52] U.S. Cl. ..... 248/210; 248/218.4; 182/129

[58] Field of Search ..... 248/210, 311.3, 312, 248/231, 211, 238, 218.4; 220/22, 90; 182/129

[56] References Cited

U.S. PATENT DOCUMENTS

| | | | |
|---|---|---|---|
| 1,286,649 | 12/1918 | Kayser . | |
| 1,825,117 | 9/1931 | Hudson . | |
| 2,213,738 | 9/1940 | Larsen . | |
| 2,827,908 | 3/1958 | Lee . | |
| 2,893,678 | 7/1959 | Hoffman et al. . | |
| 2,988,767 | 6/1961 | Tretwold | 220/90 X |
| 2,988,768 | 6/1961 | Hill | 248/210 X |
| 3,193,232 | 7/1965 | Hatcher . | |
| 3,227,411 | 1/1966 | Treutler . | |
| 3,612,460 | 10/1971 | Smith . | |
| 3,891,174 | 6/1975 | Harvey . | |
| 3,929,312 | 12/1975 | Uke . | |
| 4,061,242 | 12/1977 | Donlon | 220/90 |
| 4,164,299 | 8/1979 | Fuhr | 220/90 X |
| 4,222,541 | 9/1980 | Cillis . | |
| 4,249,716 | 2/1981 | Barron . | |
| 4,270,722 | 6/1981 | Batchelder . | |
| 4,310,134 | 1/1982 | Schopp et al. . | |
| 4,383,669 | 5/1983 | Rasler . | |
| 4,436,215 | 3/1984 | Kleinert | 220/22 X |
| 4,446,986 | 5/1984 | Bowen | 220/90 X |
| 4,624,430 | 11/1986 | Ehmke . | |
| 4,681,219 | 7/1987 | Kitchens . | |
| 4,756,439 | 7/1988 | Perock | 220/90 X |
| 4,761,008 | 8/1988 | Huggins | 220/22 X |

FOREIGN PATENT DOCUMENTS

| | | | |
|---|---|---|---|
| 3228917 | 2/1984 | Fed. Rep. of Germany | 224/148 |

*Primary Examiner*—Alvin C. Chin-Shue

*Attorney, Agent, or Firm*—John F. A. Earley; John F. A. Earley, III; P. Michael Walker

[57] ABSTRACT

A container for attachment to a ladder has a bottom wall, four upwardly depending side walls, and a pair of elastic cords having hooks on both ends wrapped around the outside of the container and around a ladder where the hooks are hooked together. The elastic cords are supported on a side wall of the container by a pair of belt loops formed in the side wall which snugly hold the elastic cords in place. The container is quickly and easily attached and detached from the side rail of a ladder.

In another embodiment of the invention, the container includes a handle, two pairs of L-shaped flanges formed on the outside walls of the container for holding work tools such as roller brushes and sanding poles, and a removable divider positioned inside the container to separate the container into two distinct portions.

Also, the container is provided with a drain hole and plug, and a pair of shelves formed in opposite side walls of the container and extending inwardly to provide an edge against which the brush may be wiped, so that the container may be used as a paint can.

1 Claim, 2 Drawing Sheets

CONTAINER FOR ATTACHMENT TO A LADDER

CROSS REFERENCE

This invention is a continuation-in-part of application Ser. No. 07/209,545 filed on June 21, 1988, now abandoned.

BACKGROUND OF THE INVENTION

1. Field Of The Invention

This invention relates to portable containers, and more specifically concerns portable containers which may be attached to a ladder for holding work tools, such as hammers, screwdrivers, caulking guns, and the like.

2. Description Of The Prior Art

In the prior art, attempts have been made to allow a worker who works on a ladder, such as a painter or a siding mechanic, to have his tools and equipment in a convenient place at the top of a ladder so that he does not have to carry his tools with him each time he goes up and down the ladder.

One solution to this problem has been for workers to wear a specially designed leather belt to hold their tools. The leather belt typically includes pockets for holding a hammer, screwdrivers, nails, tape measures, and the like. Such leather belts are usually thick and wide, and weigh the worker down when he moves up and down the ladder with all of his tools in his belt. The leather belt is dangerous, because if the worker falls from the ladder he may be severely injured by falling upon sharp objects such as screwdrivers and knives and heavy objects such as hammers that are in his belt.

Another problem with a leather belt is it usually has no place to hold a caulking gun, which makes the caulking gun one of the most difficult tools to use while on a ladder because there is no convenient place at the top of a ladder to put it when it is not in use. If it is attempted in some way to attach the caulking gun to the worker's leather belt, the size of the caulking gun restricts his movement and can also leak caulking from the tip of the gun onto the worker's clothing.

A particularly dangerous tool to use at the top of a ladder is a blow torch. Painters often use blow torches to remove old layers of paint. When a blow torch is not in use, it is dangerous because it is heavy and may fall and injure someone, and because after use it is hot at the tip, and may easily burn the user.

In recent years, attempts have been made to provide support trays for attachment to a ladder, such as is shown in U.S. Pat. No. 4,222,541, which discloses a tray secured to the side of a step ladder by a series of brackets that are held together by nuts and bolts.

A problem with these types of containers is that they difficult and time-consuming to install. The installation of the tray shown in U.S. Pat. No. 4,222,541 requires that the worker position a first bracket having two studs against the side of the ladder with one hand, and then place a second bracket, which is attached to the tray, through the studs of the first bracket. While holding the assembly in place with one hand, the worker's free hand threads wing nuts onto the bolts. The bolts are then tightened to secure the tray to the ladder. If the worker moves to a different position on the ladder to work, the bracket assembly must be taken apart and reassembled at the new position on the ladder.

Workers in the construction industry, and particularly the painting and siding industries, are often paid by the job, and not by the hour. Therefore, it is of utmost importance that the worker be able to move quickly up and down a ladder as he performs his work, because in that way he makes more money. A worker does not have the time required to constantly disassemble and reassemble a set of brackets held together by nuts and bolts each time he must move to a different position on the ladder.

SUMMARY OF THE INVENTION

It is an object of this invention to provide a container for holding a worker's tools that is quickly and easily attached to and detached from a stationary support such as a ladder.

Another object of the invention is to provide a container that holds tools that are awkward for a worker to use on a ladder, such as caulking guns, screwdrivers, hammers and the like.

Still another object of the invention is to provide a container which may be attached to a variety of stationary objects, including an extension ladder, a step ladder, scaffolding, and a worker's leg.

A further object of this invention is to provide a container that allows for greater safety in use of tools on top of a ladder, including heavy and dangerous items like blow torches.

In accordance with these and other objects of the invention, there is shown a container that is quickly and easily attached to a ladder and quickly and easily detached and moved to another position on the ladder while providing a stable and secure attachment to the ladder.

The invention includes a container having a square base and four side walls with a bungee cord having hooks at both ends wrapped around the outside walls of the top of the container and hooked around the ladder or other structure it is desired to hold the container against. To strengthen the attachment to the adjoining structure and to stabilize that attachment, a second bungee cord having hooks may be wrapped around the bottom side walls of the container and around the structure the container is to be held against.

The bungee cords are held in the proper position against the container by belt loops that are formed in a side wall of the container. The belt loops are located at different heights on the side wall with one bungee cord passing through one belt loop. The belt loops form an opening that is approximately the same size as the thickness and width of the bungee cord so that the bungee cord snugly fits into the belt loop.

DETAILED DESCRIPTION

Figure 1:
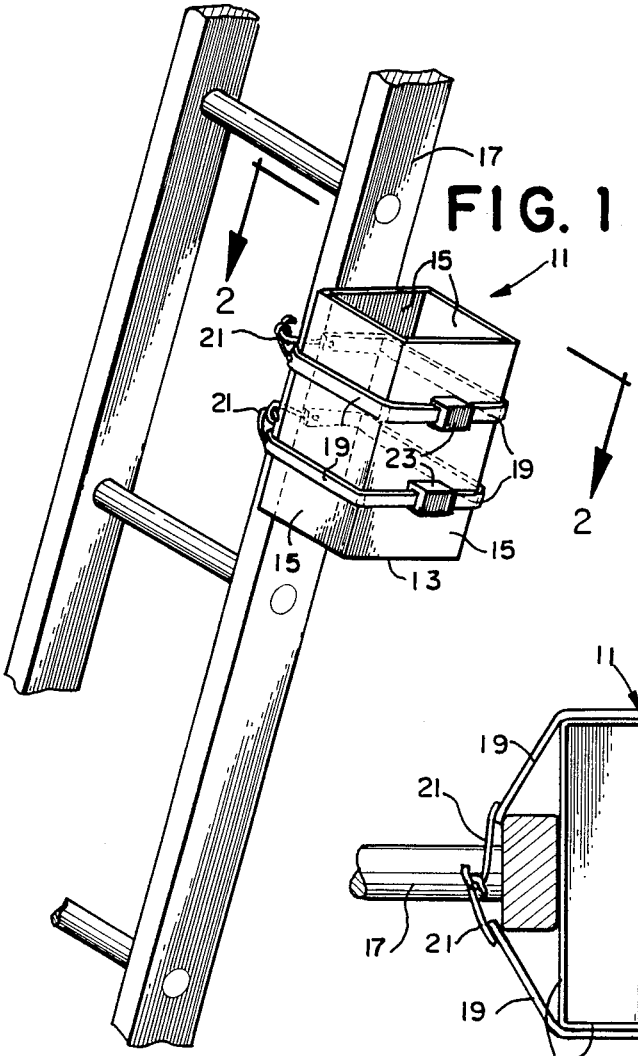
FIG. 1 is a view in perspective of a container constructed in accordance with this invention that is attached to a ladder.

Turning now to the drawings, there is shown a container 11 having a bottom wall 13 and four upwardly depending side walls 15. Container 11 may be constructed of any durable material, such as plastic, metal or wood.

Container 11 includes means located around the outside of side walls 15 for demountably attaching container 11 to a stationary support, such as ladder 17. The attaching means may include elastic cords such as bungee cords 19 which wrap around container 11. Bungee cords 19 have hooks 21 which are attached at both ends of each bungee cord 19 and provide a means for hooking the ends of bungee cords 19 together around container 11 and ladder 17 for securely holding container 11 in place.

One of said side walls 15 includes means formed therein for positioning and supporting the bungee cords 19 on the container 11. The supporting means includes a pair of belt loops 23 formed in side wall 15. In a preferred embodiment, belt loops 23 are C-shaped and form an opening wide enough for bungee cords 19 to easily pass therethrough, but at the same time provide a snug fit to prevent the bungee cords 19 from easily slipping out of belt loops 23. Belt loops 23 are preferably positioned at different heights along said side wall 15 to provide a secure and stable attachment of container 11 to ladder 17.

Bottom wall 13 may include drain hole 25 to allow for the drainage of water which may collect in container 11.

In operation, container 11 is filled with work tools and carried to a desired position on ladder 17 where bungee cords 19 are wrapped around the side of ladder 17 and hooks 21 are hooked together to securely attach container 11 to ladder 17. Bungee cords 19 are preferably positioned and hooked just above the rungs of ladder 17 to prevent container 11 from slipping down the side of ladder 17. Container 11 may be attached to either the right-hand side or left-hand side of ladder 17.

Container 11 is not limited to being attached only to ladder 17, but may be attached to any object that will make it convenient for a worker to reach his tools, such as scaffolding or a railing. Container 11 may also be attached to a worker's leg.

The preferred attaching means is bungee cord 19, but any other type of mounting cord can be used, such as a piece of rope as long as it provides a secure attachment of container 11 to ladder 17.

Figure 2:
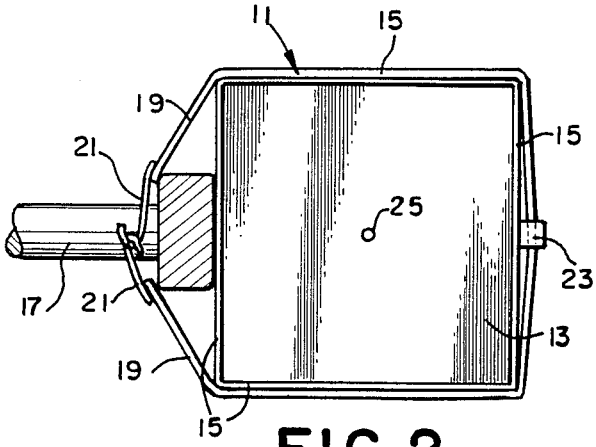
FIG. 2 is a top plan view of the container and is taken as indicated by the lines and arrows 2—2 which appear in FIG. 1.
Figure 3:
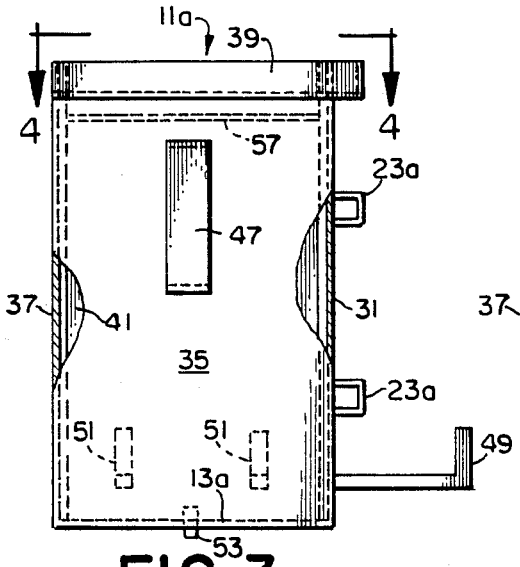
FIG. 3 is a side view in elevation of another embodiment of the invention.
Figure 4:
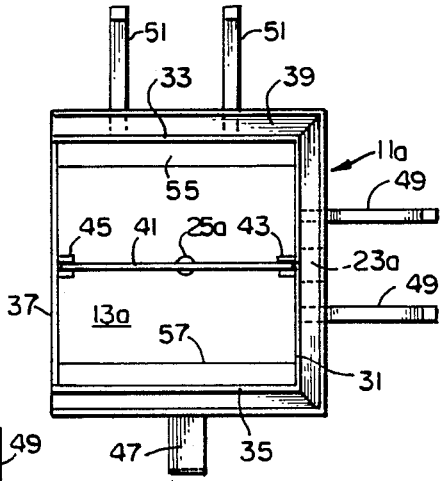
FIG. 4 is a top plan view of the container of FIG. 3 and is taken as indicated by the lines and arrows 4—4 which appear in FIG. 3.
Figure 5:
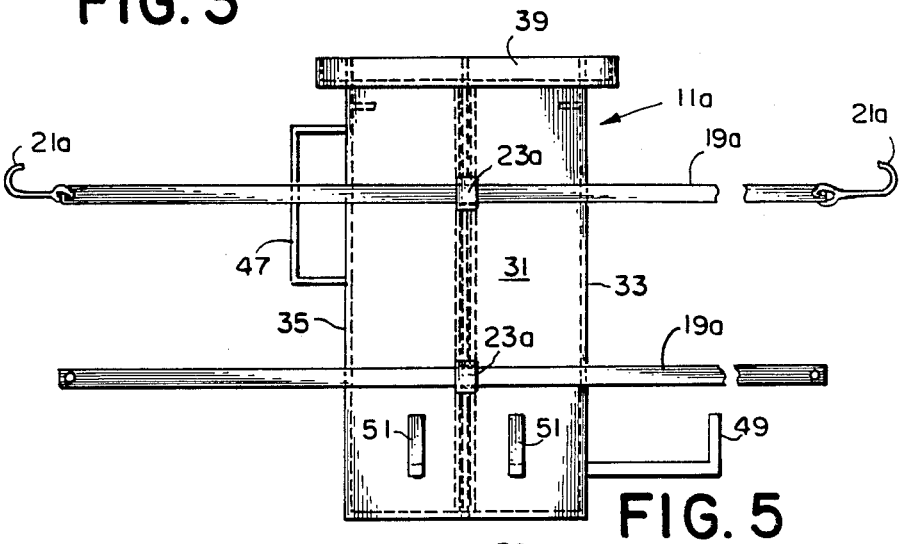
FIG. 5 is a rear view in elevation of the embodiment of the invention shown in FIG. 3.

The bungee cords 19 shown in FIGS. 1 and 2 are long enough to wrap around container 11 and ladder 17, but this length is for illustrative purposes only. The length of bungee cords 19 may be varied depending upon the type of support against which container 11 is to be mounted. For example, mounting container 11 against a thick support column (not shown) requires longer bungee cords 19.

Container 11 may include only one belt loop 23 and one bungee cord 19, but it is preferred to have two belt loops 23 and two bungee cords 19 to provide stability to container 11 when it is attached to ladder 17.

Bottom wall 13 is shown to be square, but it may have a shape other than flat and square, without departing from the spririt of the invention.

Turning to FIGS. 3–6, there is shown another embodiment of the invention, container **11*a***.

Container **11*a* has a bottom wall 13*a*, front wall 31, side walls 33, 35 and rear wall 37**.

Bungee cords **19*a* (FIG. 6) are wrapped around outside walls 31, 33, 35, 37 for demountably attaching container 11*a* to a stationary support, such as ladder 17*a*. Bungee cords 19*a* have hooks 21*a* which are attached at both ends of each bungee cord 19*a* and provide a means for hooking the ends of bungee cords 19*a* together around container 11*a* and ladder 17*a* for securely holding container 11*a*** in place.

A pair of belt loops **23*a* are formed in front wall 31 at different heights thereon. Belt loops 23*a* include openings which allow bungee cords 19*a* inserted therethrough for attaching it to a ladder 17*a***.

Container **11*a* further includes a U-shaped channel 39 formed at the top of side wall 33, front wall 31, and side wall 35. Channel 39 is wide enough to hold a variety of small items, such as wing nuts, bolts, nuts, screws and the like, and still allow a workman to grasp the items with his fingers and remove the items therefrom. Channel 39 allows easy access to small items which otherwise would be stored on bottom wall 13*a* of container 11*a***, where their retrieval would be difficult.

Channel 39 is formed on the outside of walls 31, 33 and 35, so as not to take away from the size of the opening in container **11*a*. There is n U-shaped channel formed at the top of rear wall 37 because wall 37 must be flush against a ladder 17*a***.

A removable divider or partition 41 (FIG. 4) is disposed in container **11*a* between front wall 31 and rear wall 37, and divides container 11*a* in half to form two separate interior chambers. Divider 41 is held in place by a slot 43 formed in front wall 31 and a slot 45 formed in rear wall 37**.

Removable divider 41 is particularly useful when it is desired to separate certain tools from each other. For example, on one side of divider 41 a workman may keep paint brushes, stirrers and other work instruments which may be coated from time to time with paint. On the other side of divider 41, the workman may keep his screwdrives, pliers and the like so as not to get paint on his tools. When it is desired to utilize the full volume of container **11*a*, divider 41** is removed.

An outwardly extending handle 47 is formed in side wall 35 of container **11*a* with the top part of handle 47 located below channel 39 and the bottom part of handle 47 located between bungee cords 19*a*. It is important that handle 47 be positioned on side wall 35 such that it does not interfere with bungee cords 19*a* when they are attached to a ladder 17*a***.

Handle 47 allows a worker to carry container **11*a* easily from place to place when it is not in use. Also, handle 47 allows a worker to safely carry a container 11*a* up a ladder 17*a* when container 11*a*** is filled with heavy tools.

Roller brush holder means, comprising a pair of L-shaped flanges 49, are formed in front wall 31 below bungee cords **19*a* and belt loops 23*a*. Flanges 49 permit a worker to safely store a roller brush on the outside of container 11*a*. Roller brushes are usually T-shaped and have handle portion formed at the bottom of the "T", and a rotatable cylinder and brush formed at the top of the "T". A roller brush, because of its unusual shape, does not fit easily inside container 11*a* and is clumsy and awkward to carry to the top of a ladder. L-shaped flanges 49** eliminate the problem of carrying roller brushes and allow them to be easily and safely stored.

Sanding pole holder means, comprising a second pair of L-shaped flanges 51, project outwardly from side wall 33. Flanges 51 are sized to hold a work instrument, such as a sanding pole holder. A sanding pole holder is a common work instrument in the painting industry, and comprises a handle such as a broom stick and a square flat surface top which holds a piece of sandpaper attached at the top of the handle. A painter grasps the handle and uses the sandpaper to sand places that are hard to reach. Such a work instrument is conveniently held outside container 11*a* on L-shaped flanges 51.

A drain hole 25*a* (FIG. 4) may be formed in bottom wall 13*a* of container 11*a* to drain liquids, such as rain water from the container. A plug 53 (FIG. 3) is provided which, when placed in drain hole 25*a*, prevents the passage of liquid therethrough. It may be desired to use container 11*a* as a paint can, in which case plug 53 is placed in drain hole 25*a* and container 11*a* is filled with paint or another liquid. Container 11*a* is an excellent paint can because it may be attached securely to a side of a ladder 17*a* while in use. When the worker is finished painting, plug 53 is removed from drain hole 25*a*, and container 11*a* is drained and cleaned for further use as a container for holding work instruments and the like.

A shelf 55 is formed inside container 11*a* on the inside of side wall 33, and a shelf 57 if formed inside container 11*a* on the inside portion of side wall 35. Shelves 55, 57 are positioned near the top of side walls 33, 35 and extend inwardly towards the center of container 11*a*. Shelves 55, 57 are useful when container 11*a* is used as a paint can, because they provide a surface against which a paintbrush that has been dipped in paint may be wiped against to remove excess paint from the brush.

Figure 6:
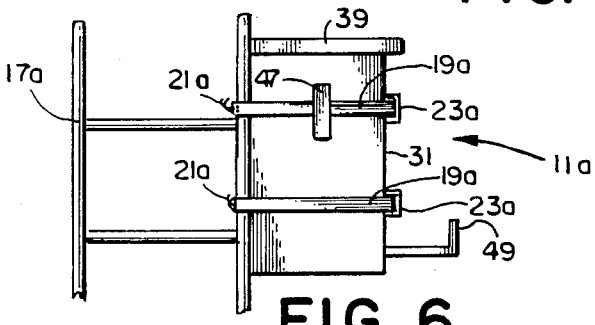
FIG. 6 is a side view in elevation of the embodiment of the invention in FIG. 3 shown attached to a ladder.

FIG. 6 shows that in a preferred embodiment of the invention, the bungee cord 23*a* and hooks 21*a* nearer to the top of container 11*a* rest on top of a rung of a ladder 17*a*.

I claim:

1. A portable open container for holding work instruments at a convenient location on a ladder, comprising a rectangular bottom wall and a front wall, rear wall and two side walls extending upwardly from the rectangular bottom wall to form a rectangular container that is open at the top to allow work instruments to be inserted therein, a pair of closed belt loops formed on the front wall of the container at different heights along the front wall and extending outwardly therefrom, a pair of elastic bands wrapped around the container through the belt loops, the belt loops positioning and supporting the elastic bands on the walls of the container, the elastic bands each including hooks at both ends which lock the ends of elastic bands together around the container for securely holding the rear wall of the rectangular container against a support, a removable divider positioned between the front wall and the rear wall at right angles thereto for dividing the container into two sections, flanges formed in the front wall and rear wall and located adjacent both sides of the divider to support and position the removable divider in the container, a pair of L-shaped support members formed on a side wall of the container and extending outwardly therefrom to hold and support a work instrument such as a roller paint brush on the outside of the container, a channel formed on the outside portion of the front wall and the two side walls at the top of the container for holding small items such as nuts, bolts, a drain hole formed in the bottom wall of the container for draining liquids therefrom, a removable liquid-tight plug positioned in the drain hole for stopping the flow of liquids from the container, a handle positioned on the outside of a side wall for carrying the container, and a shelf formed on the inside portion of a side wall extending into the container to provide a surface against which a work instrument may be wiped, wherein when it is desired to attach the open container to a ladder or the like, the container is placed flush against the ladder and the ends of the elastic bands are wrapped around the side of the ladder and hooked together to securely hold the container to the ladder and the rectangular shape of the container provides a stable and secure interface between the ladder and the container.

* * * * *